United States Patent [19]

Reinkemeyer

[11] Patent Number: 4,664,778

[45] Date of Patent: May 12, 1987

[54] METHOD FOR REGENERATION OF RESID CRACKING CATALYST

[75] Inventor: Leo R. Reinkemeyer, Aurora, Colo.

[73] Assignee: Total Engineering and Research Company, Denver, Colo.

[21] Appl. No.: 720,171

[22] Filed: Apr. 5, 1985

[51] Int. Cl.[4] ..... C10G 11/18; B01J 38/20

[52] U.S. Cl. ..... 208/113; 208/155; 208/159; 208/160; 502/41; 502/43; 502/44

[58] Field of Search ..... 208/153, 159, 164, 113, 208/155, 160; 502/38, 41, 43, 44, 49, 52

[56] References Cited

U.S. PATENT DOCUMENTS

| | | | |
|---|---|---|---|
| 2,420,542 | 5/1947 | Jahnig | 208/159 |
| 2,431,462 | 11/1947 | Campbell et al. | 208/159 |
| 2,433,798 | 12/1947 | Voorhees | 502/43 |
| 2,492,948 | 1/1950 | Berger | 502/44 |
| 2,518,693 | 8/1950 | Jahnig | 502/44 |
| 2,662,050 | 12/1953 | Moorman et al. | 502/44 |
| 2,735,743 | 2/1956 | Rex | 208/159 |
| 2,788,311 | 4/1957 | Howard et al. | 582/43 |
| 4,093,537 | 6/1978 | Gross et al. | 208/164 |
| 4,331,533 | 5/1982 | Dean et al. | 208/113 |
| 4,332,674 | 6/1982 | Dean et al. | 208/120 |
| 4,336,160 | 6/1982 | Dean et al. | 208/113 |
| 4,464,476 | 8/1984 | Varady | 502/41 |

*Primary Examiner*—Andrew H. Metz
*Assistant Examiner*—Anthony McFarlane
*Attorney, Agent, or Firm*—Sheridan, Ross & McIntosh

[57] ABSTRACT

An improved process for hydrocarbon conversion-catalyst regeneration processes particularly useful for residual oil, especially high carbon content residual oil conversion. The process generally comprises cooling the compressed air which is introduced into the second stage catalyst regeneration vessel in order to allow processing of feeds which typically produce high coke loading of catalyst in the conversion zone. The cooling process described can be installed and maintained with minimal expense in existing facilities and generally comprises a refrigeration unit and a heat exchange means installed in the conduit transporting air from a compressor unit to the second stage catalyst regenerator air distributor means.

44 Claims, 1 Drawing Figure

METHOD FOR REGENERATION OF RESID CRACKING CATALYST

FIELD OF THE INVENTION

This invention relates to process used in catalytic cracking of resid oils and particularly to an improved method of regenerating catalysts used in such cracking.

BACKGROUND OF THE INVENTION

Residual oils, including reduced crude oils, atmospheric tower bottoms, topped crudes, vacuum resids and heavy oils, are considered difficult to catalytically crack to form high yields of gasoline plus lower and higher boiling hydrocarbon fractions because of the deposition of large amounts of coke deposited on the catalyst during the cracking. Furthermore, metal contaminants in the heavy oil fractions of crude oil are deposited on and/or in the pores of the catalyst, thereby further poisoning and inactivating the catalyst so employed. At one time, resid oils were regarded as distress stocks by the petroleum industry.

Largely within the last ten years, methods have been devised for the simultaneous conversion of both the high and low boiling components contained in residual oils with high selectivity to gasoline and lighter components and with low coke production. These conversion processes have been made possible largely because of the use of two-stage catalyst regeneration processes. In the first stage of such regeneration processes, catalyst particles, which have deposited on them hydrocarbonaceous materials such as coke, are regenerated under conditions of oxygen concentration and temperature selected to particularly burn hydrogen associated with hydrocarbonaceous material. These conditions result in a residual level carbon left on the catalyst and production of a CO-rich flue gas. This relatively mild first stage regeneration serves to limit local catalyst hot spots in the presence of steam formed during the hydrogen combustion so that formed steam will not substantially reduce the catalyst activity. A partially regenerated catalyst is recovered from the first regenerator substantially free of hydrogen. The hydrogen-free catalyst comprising residual carbon is passed to a second stage, higher temperature regenerator where the remaining carbon is substantially completely burned to $CO_2$ at an elevated temperature within the range 1400° F. up to 1800° F.

The second stage high temperature regenerator is designed to minimize catalyst inventory and catalyst residence time at the high temperature while promoting a carbon burning rate to achieve a carbon on recycled catalyst less than 0.5, preferably less than 0.1 and most preferably less than 0.05 weight percent. This second stage regeneration is conducted in the presence of sufficient oxygen to substantially burn residual carbon deposits, CO and produce $CO_2$-rich flue gas.

The regenerated catalyst is withdrawn from the second stage and charged to the riser reactor at a desired elevated temperature and in an amount sufficient to vaporize the hydrocarbon feed. The catalyst particles are at a temperature typically above 1400° F. and at least equal to the pseudo-critical temperature of the hydrocarbon feed comprising the residual oils. The catalyst particles are at a temperature such that, at the selected catalyst feed rate and hydrocarbon feed rate, the vaporizable components of the hydrocarbon feed are substantially completely vaporized in the riser reactor whereby thermal and catalytic cracking of the feed is accomplished. Resid cracking processes employing this process are described in U.S. Pat. Nos. 4,331,533 and 4,332,674.

The above-described processes, then, made possible catalytic cracking of resid oils by solving what had been thought to be two temperature limitations on the process, namely (1) metallurgical limits of the regeneration equipment and (2) thermal stability of the catalyst. Those processes were able to extend the temperature of regeneration up to at least 1800° F. without unduly impairing catalyst activity, and could be performed in equipment or apparatus capable of withstanding the severe temperature operations contemplated by those processes. Removing such temperature restrictions on the regeneration step made feasible the high temperature conversion processes which were required to convert residual oils.

These processes are not without some temperature restraints, however. For instance, the cracking catalysts typically used lose their catalytic properties when subjected to sufficiently high temperature for extended periods. As the coke-formation potential of the feed increases, e.g. because of increased Ramsbottom carbon content, the amount of coke deposited on each particle of catalyst, all other factors being held constant, will increase, leading to greater coke burning in the regeneration stage and thus hotter catalyst entering the riser. It has been found, for example, that as the Ramsbottom carbon content of the feed approaches around 4 to 5, the regenerated catalyst is reaching temperatures which begin to produce problems for the conversion process.

One solution to this problem might be a direct dissipation of heat from the cracking/regeneration cycle. This solution is unattractive for two reasons. First, techniques for direct heat dissipation from the cracking/regeneration cycle typically require apparatus which is expensive to produce, install and maintain. Second, direct heat dissipation represents a waste of the heat value of the hydrocarbon feed.

Accordingly, it would be advantageous to provide a hydrocarbon conversion-catalyst regeneration process operable with high carbon content feeds at high feed rates and/or which is easy to retrofit on existing equipment and/or which increases the percentage of resid in the acceptable feed.

It is an object of this invention to provide a process for conversion of hydrocarbons and regeneration of cracking catalyst having means for reducing the temperature of the regenerated catalyst.

It is another object of this invention to provide a process for conversion of hydrocarbons and regeneration of cracking catalysts which is usable with hydrocarbon feeds having a high carbon content.

It is still a further object of this invention to provide a cracking catalyst regeneration process including cooling means which are easily installed and maintained in existing facilities.

SUMMARY OF THE INVENTION

It has now been found that cooling the oxygen source to the catalyst regeneration step can result in the ability to crack more resid and therefore to permit feedstocks of higher carbon content. According to the process of the present invention, means are provided for cooling the oxygen source to the catalyst regeneration step. In particular, the oxygen source is first compressed and the compressed gas is cooled before introduction into the regeneration vessel.

As noted above, recent resid oil conversion-catalyst regeneration processes include a two-stage catalyst regeneration process in which the second stage regeneration requires introduction of oxygen. In a preferred embodiment, it is this oxygen source to the second stage regenerator which is first cooled. Existing facilities for resid conversion typically accomplish this oxygen introduction by compressing an oxygen-containing gas, usually air, to achieve a pressure above atmospheric, and introducing this compressed gas into the second stage regeneration vessel. It is well known that increasing the pressure of the gas, while other factors are held constant, results in an increase in the gas temperature. Thus, heretofore introduction of compressed gas into the second stage regeneration vessel represented a net heat input for the complete conversion-regeneration cycle.

The process of the present invention comprises cooling the gas before introduction into the second stage regeneration vessel. Such cooling reduces or eliminates the external heat input which otherwise occurs in conjunction with input of compressed air to the process. Such reduction of heat input makes possible the increase in heat input at some other stage of the cycle, such as increasing the carbon content of the feed, without decreasing the feed rate.

Because existing equipment used in resid conversion-catalyst regeneration processes typically contain second stage regeneration oxygen introduction means such as an external air blower, the process of the present invention can be accomplished with minimal cost of installation and maintenance by providing cooling means for the compressed air before its introduction to the second stage regeneration vessel.

DETAILED DESCRIPTION OF THE PREFERRED EMBODIMENTS

Figure 1:
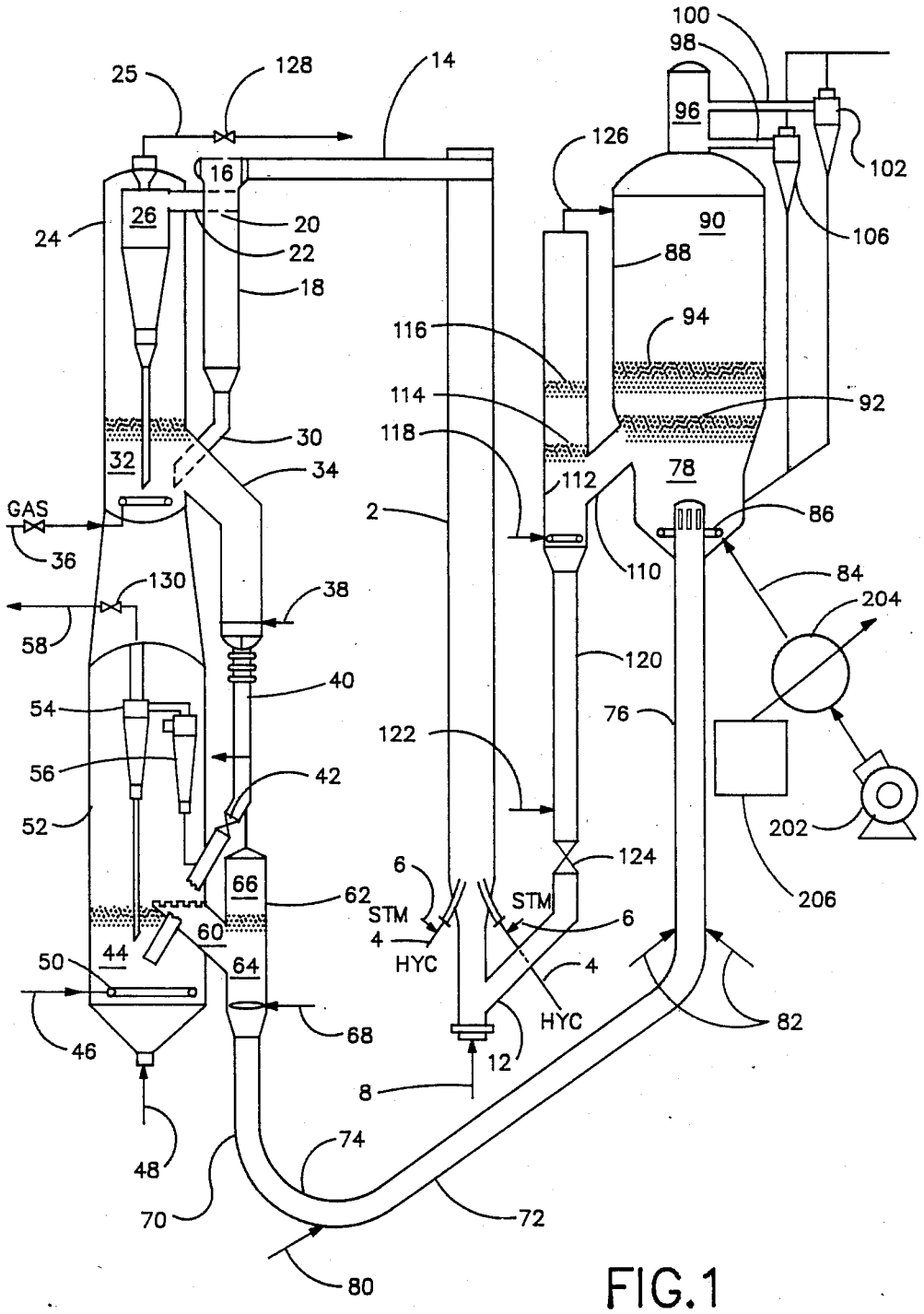
FIG. 1 is a diagrammatic sketch in elevation of an embodiment of the present invention depicting a side-by-side two-stage regenerator arrangement in combination with a riser hydrocarbon conversion with cooling means inserted in the second stage regenerator air blower stream.

In the processing schemes discussed below, arrangements of apparatus are provided for accomplishing the relatively high temperature catalyst cracking of residual oil to produce gasoline boiling range material and hydrocarbon materials readily converted into gasoline boiling components and fuel oils. Regeneration of the cracking catalyst so employed is accomplished particularly in a two-stage catalyst regeneration operation maintained under temperature restricted conditions in a first separate regeneration zone to particularly remove hydrogen deposited by hydrocarbonaceous products of the cracking operation. CO formation in the first generation zone is not particularly restricted and deactivation of the catalyst by steam formed in the hydrogen-burning operation is held to a desired low level. Thereafter, hydrogen-free residual carbon is removed from the partially regenerated catalyst in a second separate relatively dense fluid catalyst system at a more elevated temperature and sufficiently high oxygen concentration restricting the formation of any significant quantity of CO or steam by effecting combustion of residual carbon deposits on catalyst. Introduction of oxygen into the second catalyst regeneration vessel is accompanied by cooling of a compressed gaseous stream to effect partial cooling of the regenerated catalyst. The catalyst thus regenerated and comprising a residual carbon on catalyst of less than about 0.2 weight percent, preferably less than about 0.1 and most preferably less than about 0.05 weight percent is recycled to the cracking operation.

Referring to FIG. 1, the hydrocarbon riser reactor 2 is provided. A hydrocarbon feed is introduced to a lower portion of the riser 2 by conduit means 4 to which steam may be introduced by conduit 6 communicating therewith. Hot regenerated catalyst at a temperature above the feed pseudo-critical temperature is introduced to the riser lower portion by conduit 12 in an amount to form a high temperature vaporized mix with the feed as provided herein. The high temperature suspension thus formed and comprising hydrocarbons, diluent and suspended catalyst thereafter passes through the riser under substantial plug flow velocity conditions minimizing catalyst slippage and providing a hydrocarbon residence time less than about ten seconds. The vaporized hydrocarbon-catalyst suspension comprising products of catalytic conversion pass laterally from the top of the riser through the conduit 14 to a zone 16 which changes the direction of flow of the suspension and forms separation thereof. Hydrocarbon vapors thus separated are caused to flow through an opening 20 in the upper wall of conduit 18 and thence by conduit 22 into a cyclone separator 26 in vessel 24. The separated vaporous hydrocarbon product and any stripping gas such as steam is thereafter recovered, and passed by conduit 25 to a product fractionation zone not shown.

Catalyst particles separated in the cyclone separator 26 are caused to flow by diplegs to a mass of catalyst collected in the bottom lower portion of vessel 24. The catalyst separated by the rough separator arrangement is collected in a downcomer zone 18 and thereafter the catalyst is passed from the bottom thereof and conduit 30 into the fluid bed of catalyst 32. Catalyst bed 32 is in open communication with an external stripping zone 34 through which the catalyst downwardly passes. Sufficient steam is added by conduit 38 to a distributor in the bottom of the stripper to maintain catalyst bed 32 thereabove in fluid-like condition during stripping thereof.

The stripped catalyst at a temperature in the range of 900° F. up to about 1200° F. is withdrawn from the bottom of the stripping zone 34 by standpipe 40 comprising flow control valve 42 for discharge into a dense fluid bed of catalyst 44 in a first stage catalyst regeneration zone 52. All of the oxygen-containing regeneration gas may be distributed and charged to the lower bottom portion or bed 44 by one or more conduits 46 and 48 at least one of which is connected to an air distributor 50. Catalyst bed 44 is retained in a lower portion of regeneration vessel 52 under restricted temperature regeneration conditions as herein provided. Cyclone separating means 54 and 56 are retained in the upper portion of vessel 52 for separating catalyst fines from CO-rich regenerator flue gas. Regeneration flue gas rich in CO is withdrawn from zone 52 by conduit 58 provided with pressure control 130.

The regeneration operation intended to be accomplished in zone 52 is one of relatively mild temperature conditions less than about 1500° F. and effected with restricted oxygen concentrations selected to particularly achieve the burning of hydrogen associated with hydrocarbonaceous deposits and burn some carbon material. This relatively mild regeneration operation is provided so that the presence of steam formed during hydrogen burning will not substantially reduce the catalyst activity. The first stage regeneration operation is effected under temperature, pressure and oxygen concentration restriction conditions which will retain some residual carbon free of hydrogen on the catalyst for burning removal in a second separate higher temperature regeneration zone 88.

The partially regenerated catalyst substantially free of hydrogen in the residual carbon deposits on the catalyst is withdrawn from the dense fluid bed of catalyst 44 by withdrawal conduit 60 communicating with an external catalyst withdrawal zone 62. Catalyst withdrawal zone 62 maintains a dense fluid downflowing mass of catalyst 64 therein with an upper interface 66. Stripped catalyst is withdrawn from zone 62 by standpipe conduit 70 and transferred to a relatively dense catalyst phase transfer zone 72 through a matching curved pipe section 74. Transfer zone 72 is in open communication with a substantially vertical catalyst transfer riser section 76 discharging into a dense fluid bed of catalyst 78 in a lower bottom portion of a second stage catalyst regeneration zone 88.

Air taken at atmospheric pressure is compressed by air compressor/blower 202 and passed to heat exchanger unit 204. The compressed air is cooled by conventional cooling means known in the art. In the configuration depicted in FIG. 1, cooling fluid from refrigeration unit 206 is passed through heat exchanger unit 204 to cool the compressed air exiting from air compressor/blower 202. The compressed cooled air is added to second stage regeneration vessel 88 by conduit 84 communicating with air distributor 86. The pressure and flow rate of the compressed cooled gas introduced into reaction vessel 88 contains sufficient oxygen that carbon combustion regeneration and substantially complete combustion of CO in the dense catalyst bed 78 to form $CO_2$ is accomplished.

The compressed air cooling means comprising air or water cooling unit 206 and heat exchange means 204 have sufficient capacity to reduce the temperature of the compressed gas by a predetermined amount. Typically, air used in the regeneration is first compressed from atmospheric pressure to a pressure of from about 20 to about 50 psig. This compression typically raises the air temperature by about 200° to about 350° F. Cooling of the compressed gas according to the present invention typically reduces the temperature of the catalyst regeneration by an amount sufficient to allow either a increase in the size of the "black oil" (+1050° F.) fraction of the feed or to reduce the regenerator temperature with an increase in conversion. In many instances, maintaining the regenerator temperature below about 1400° F., e.g. from about 1340° to about 1400°, is particularly advantageous. In the unit depicted in FIG. 1, for example, reducing a substantial portion of the heat of compression allows the temperature of the regenerator to advantageously be reduced by about 40° to about 80° F. Alternatively, the reduction of heat input to the catalyst regeneration, permits hydrocarbon feed having a high Ramsbottom carbon content, in the range of 4 to 5 or higher to be employed. In addition, it is possible to employ feed rates substantially the same or even increased with increase of the "black oil" without producing process temperatures in excess of the temperature capacities of the conversionregeneration processes and apparatus.

Cooling unit 206 and heat exchange means 204 are readily installed into the compressed gas conduit 84 of existing facilities, so that no substantial alteration of refractory lined vessel 88 is needed. Thus, the practice of the present invention requires only minimal alteration of existing equipment. Because the refrigeration unit 206 and heat exchange means 204 operate on a gas stream which is external to the hydrocarbon conversioncatalyst regeneration closed cycle, removal of heat from the compressed gas stream does not involve waste of any heat values contained in the hydrocarbon feed 4.

The flue gas from the second stage catalyst regeneration is withdrawn from a plenum chamber 96 above the regeneration vessel as two separate flue gas streams 98 and 100. Each passing through a separate cyclone separator 102 and 106 respectively. Catalyst particles separated in the cyclone separators are passed by diplegs provided for each cyclone separator to fluid catalyst bed 78 in vessel 88.

Regenerated catalyst at a temperature in the range of 1500° F. to 1800° F. is withdrawn from the dense catalyst bed 78 below level 92. The hot regenerated catalyst thus obtained is withdrawn by conduit 110 and passed to an adjacent refractory lined catalyst collecting zone 112. This catalyst is withdrawn by standpipe 120 communicating with conduit 12. The high temperature regenerated catalyst passing through valve 124 is then charged into the riser cracking zone by conduit 12 for use as herein described.

As will be known and understood by those skilled in the art, practice of the present invention may be effected in one stage regeneration or in a number of alternatively configured two stage units, e.g. the stacked unit as depicted in U.S. Pat. No. 4,332,674. Similarly, in any two stage regeneration the cooled air may be that entering either or both units. As will also be known and understood, cooling of the catalyst regenerator air in most prior art regeneration operations has generally been counterindicated due to the problem of incomplete burn-off of the coke deposits on the catalyst particles. In many past processes, too little heat in the regenerator units, as opposed to too much heat, has been the problem. Only with the technology by which resid or black oil fraction are cracked has the overall processing faced the problem of excessive heat. Practice of the present invention is based upon the discovery that in a catalyst cracking/regeneration operation such as that depicted in FIG. 1, a system-wide heat balance exists which interrelates the catalyst regeneration temperature with the heat generated in the cracking operation.

The combined hydrocarbon conversion-catalyst regeneration process has been found to be substantially heat balanced in the sense that the heat for vaporizing and reacting the feed is derived by combustion of the coke produced in the regenerator. The heat of combustion of the coke is transferred by the catalyst circulation to the riser reactor. The regeneration system has a certain ability to accommodate operational variations. To some extent it is able to thermally stabilize itself automatically. A change in the coke burning rate, for instance, through a series of changes in operating variables, will result in a compensating change in the coke-forming rate. As a result, the coke production tends to oppose the direction in which the regenerator temperature moves. As catalyst to oil ratio is lowered during cracking, the coke deposited on the given amount of catalyst increases and the catalyst temperature also increases. Similarly, if a feedstock with more coke-forming tendency is used, the amount of coke deposited on the catalyst increases and the catalyst temperature again increases.

The following Examples are provided by way of illustration and not by way of limitation.

EXAMPLE 1

Calculations are made to compare the operation of a refinery, such as that depicted in FIG. 1, having cooling of the air entering the second stage catalyst regenerator to operations without such cooling. In Case I, no cooling is performed. In Cases II and III, the air introduced into the second stage catalyst regenerator is cooled by 230° F. This amount of cooling is within the capacity of known cooling systems. The results are presented in Table A.

TABLE A

| | Case I | Case II | Case III |
|---|---|---|---|
| Temperature of Air Entering 2nd Stage Regenerator | 350° F. | 120° F. | 120° F. |
| Temperature of Catalyst in 2nd Stage Regenerator | 1387° F. | 1334° F. | 1389° F. |
| Temperature of Catalyst in lst Stage Regenerator | 1192° F. | 1164° F. | 1194° F. |
| Percent Conversion | 68.74 | 70.55 | 68.66 |
| "Black Oil" Concentration of Feed (Percent) | 25 | 25 | 30 |

As can be seen from this table, with the second stage regenerator cooling of Case II, the temperature of catalyst in the second stage regenerator is decreased by 53° F. and the temperature of the catalyst in the first stage regenerator is decreased by 28° F. This temperature decrease permits an increase in the throughput without creating overheating. The amount of resid conversion in Case II is 1.8% greater than the amount of conversion in Case I. In Case III, the "black oil" or resid content of the feed is 15% higher than that of Case I, while the second stage regenerator temperature is only negligibly higher.

Although the foregoing invention has been described in detail for purposes of clarity and understanding, as will be known and understood by those skilled in the art, changes and modifications may be made without departing from the spirit of the invention which is limited only by the appended claims.

What is claimed is:

1. In a combination hydrocarbon cracking-catalyst regeneration process comprising catalytic cracking in a riser conversion zone, separating catalyst particles comprising hydrocarbonaceous deposits from hydrocarbon conversion products, regenerating said separated catalyst particles in at least one catalyst regeneration zone in the presence of a source of oxygen, and recycling said regenerated catalyst to said riser conversion zone, the improvement comprising:

cooling the source of said oxygen prior to contacting said separated catalyst particles and prior to introduction into said regeneration zone to decrease the temperature of said regeneration zone by up to about 80° F.

2. The process of claim 1 wherein the source of said oxygen is air.

3. The process of claim 2 wherein said air is compressed prior to cooling.

4. The process of claim 1 wherein said regenerating is by two stage regeneration.

5. The process of claim 4 wherein the source of oxygen to one stage of said two-stage regeneration is cooled.

6. The process of claim 5 wherein one of said two stages is operated at a temperature below about 1500° F. and the other stage is operated below about 1800° F.

7. The process of claim 5 wherein the one of said two stages is operated at a temperature below about 1400° F. and the other stage is operated below about 1800° F.

8. The process of claim 4 wherein the source of oxygen to each stage of said two-stage regeneration is cooled.

9. The process of claim 1 wherein said process is heat balanced and said cooling reduces the temperature of said regeneration zone by an amount sufficient to allow an increase in the amount of coke deposited on the catalyst in the cracking zone and to maintain the heat balance of the process.

10. The process of claim 1 wherein said regeneration zone is reduced by at least about 28° F.

11. The process of claim 1 wherein the temperature of said regeneration zone is reduced by at least about 40° F.

12. The process of claim 1 wherein the temperature of said regeneration zone is maintained below about 1400° F.

13. The method of claim 1 wherein said process is heat balanced and said source of oxygen is cooled by an amount sufficient to maintain said heat balance when the amount of feedstock which boils above about 1050° F. is increased.

14. The method of claim 1 wherein said process is heat balanced and said source of oxygen is cooled by an amount sufficient to maintain said heat balance when the rate at which said feedstock is added to said riser cracking zone is increased.

15. In a combination hydrocarbon cracking-catalyst regeneration process comprising catalytic cracking in a riser conversion zone, separating catalyst particles comprising hydrocarbonaceous deposits from hydrocarbon conversion products, partially regenerating said separated catalyst particles in the presence of oxygen in a first catalyst regeneration zone under conditions selected to burn hydrogen associated with hydrocarbonaceous material thereby leaving residual carbon on the catalyst, passing catalyst particles thus partially regenerated to a second separate catalyst regeneration zone, further regenerating said partially regenerated catalyst in the second regeneration zone in the presence of sufficient oxygen to substantially completely burn residual carbon deposits and CO and produce $CO_2$-rich flue gas, and recycling said further regenerated catalyst to said riser conversion zone, the improvement comprising:

cooling said oxygen prior to contacting said separated catalyst particles and prior to introducing it into at least one of said regeneration zones to reduce the temperature of said one regeneration zone by up to about 80° F. to maintain the first regeneration zone below about 1500° F. and the second regeneration zone below about 1800° F.

16. The process of claim 15 wherein said oxygen is introduced as air.

17. The process of claim 16 wherein said air is compressed prior to cooling.

18. The process of claim 15 wherein said hydrocarbon feed is residual oil.

19. The process of claim 18 wherein said residual oil has a Ramsbottom carbon content greater than about 4.

20. The process of claim 15 wherein said cooling of said oxygen is increased as the Ramsbottom carbon content of said hydrocarbon is increased.

21. The process of claim 15 comprising cooling the oxygen of said first regeneration zone.

22. The process of claim 15 comprising cooling the oxygen of said second regeneration zone.

23. The process of claim 15 comprising cooling the oxygen of both said first and second regeneration zones.

24. The process of claim 15 wherein said cooling is in an amount sufficient to maintain the temperature of said first regeneration zone at below about 1400° F.

25. The process of claim 15 wherein said process is heat balanced and the temperature of said oxygen is decreased by an amount sufficient to allow an increase in the amount of coke deposited on the catalyst in the cracking zone and to maintain the heat balance of the process.

26. The process of claim 15 wherein the temperature of at least one of said regeneration zones is reduced by at least about 28° F.

27. The process of claim 15 wherein the temperature of at least one of said regeneration zones is reduced by at least about 40° F.

28. The process of claim 15 wherein the temperature of said first regeneration zone is maintained below about 1400° F. and the temperature of said second regeneration zone is maintained below about 1800° F.

29. In a heat-balanced combination hydrocarbon cracking-catalyst regeneration process comprising catalytic cracking in a riser conversion zone, separating catalyst particles comprising hydrocarbonaceous deposits from hydrocarbon conversion products, regenerating said separated catalyst particles in at least one catalyst regeneration zone in the presence of a source of oxygen, and recycling said regenerated catalyst to said riser conversion zone, the improvement comprising:

cooling the source of said oxygen prior to contacting said separated catalyst particles and prior to introducing it into said regeneration zone to reduce the temperature of said regeneration zone to maintain the heat balance when the amount of coke deposited on the catlyst in the conversion zone is increased to at least about 0.2 weight percent.

30. In a heat-balanced combination hydrocarbon conversion-catalyst regeneration process comprising catalytic cracking in a riser conversion zone, separating catalyst particles comprising hydrocarbonaceous deposits from hydrocarbon conversion products, partially regenerating said separated catalyst particles in the presence of oxygen in a first catalyst regeneration zone under conditions selected to burn hydrogen associated with hydrocarbonaceous material thereby leaving residual carbon on the catalyst, passing catalyst particles thus partially regenerated to a second separate catalyst regeneration zone, further regenerating said partially regenerated catalyst in the second regeneration zone in the presence of sufficient oxygen to substantially completely burn residual carbon deposits and CO and product $CO_2$-rich flue gas, and recycling said further regenerated catalyst to said riser conversion zone, the improvement comprising:

cooling said oxygen prior to contacting said separated catlyst particles and prior to introducing it into at least one of said regeneration zones to reduce the temperature of said cooled regeneration zone to maintain the heat balance when the amount of coke deposited on the catalyst in the conversion zone is increased to at least about 0.2 weight percent.

31. In a combination hydrocarbon cracking-catalyst regeneration process comprising catalytic cracking in a riser cracking zone, separating catalyst particles comprising hydrocarbonaceous deposits from hydrocarbon cracking products, regenerating said separated catalyst particles in a catalyst regeneration zone in the presence of a source of oxygen, and recycling said regenerated catalyst to said riser cracking zone, the improvement comprising:

cooling the source of said oxygen prior to contacting said separated catalyst particles and prior to introduction into said regeneration zone wherein the temperature of said regeneration zone is reduced by at least about 28° F.

32. The process of claim 31 wherein the temperature of said regeneration zone is reduced by at least 40° F.

33. The process of claim 31 wherein the source of said oxygen is air.

34. The process of claim 33 wherein said air is compressed prior to cooling.

35. The process of claim 31 wherein said regenerating is by two-stage regeneration.

36. The process of claim 35 wherein the source of oxygen in one stage of said two-stage regeneration is cooled.

37. The process of claim 36 wherein one of said two stages is operated at a temperature below about 1500° F. and the other stage is operated below about 1800° F.

38. The process of claim 36 wherein said one of said two stages is operated at a temperature below about 1400° F. and the other stage is operated below about 1800° F.

39. The process of claim 35 wherein the source of oxygen to each stage of said two-stage regeneration is cooled.

40. The process of claim 31 wherein said hydrocarbon feed is residual oil.

41. The process of claim 40 wherein said residual oil has a Ramsbottom carbon content greater than about 4.

42. The process of claim 31 wherein said cooling of said source of oxygen is increased as the Ramsbottom carbon content of said hydrocarbon is increased.

43. The method of claim 31 wherein said process is heat balanced and said oxygen source is cooled by an amount sufficient to maintain said heat balance when the amount of feedstock which boils above about 1050° F. is increased.

44. The method of claim 31 wherein said process is heat balanced and said oxygen source is cooled by an amount sufficient to maintain said heat balance when the rate at which said feedstock is added to said riser cracking zone is increased.

* * * * *